US011376807B2

(12) United States Patent
Obrecht et al.

(10) Patent No.: US 11,376,807 B2
(45) Date of Patent: Jul. 5, 2022

(54) INTERNALLY-DRIVEN PRESS ASSEMBLY

(71) Applicant: REO Hydro-Pierce Inc., Detroit, MI (US)

(72) Inventors: Robert E. Obrecht, Detroit, MI (US); Rudy Vandenbroeck, Grosse Pointe Shores, MI (US)

(73) Assignee: REO HYDRO-PIERCE, INC., Detroit, MI (US)

( * ) Notice: Subject to any disclaimer, the term of this patent is extended or adjusted under 35 U.S.C. 154(b) by 524 days.

(21) Appl. No.: 16/211,698

(22) Filed: Dec. 6, 2018

(65) Prior Publication Data

US 2020/0180251 A1 Jun. 11, 2020

(51) Int. Cl.
*B30B 1/18* (2006.01)

(52) U.S. Cl.
CPC ..... *B30B 1/185* (2013.01); *B30B 1/18* (2013.01)

(58) Field of Classification Search
CPC ..... B30B 1/18; B30B 1/181; B30B 1/185; B30B 15/047; F16H 21/44; F16H 25/20; F16H 25/24; F16H 25/2015; F16H 2025/2081; F16H 2025/2075; F16H 2025/2078; Y10T 74/18648
See application file for complete search history.

(56) References Cited

U.S. PATENT DOCUMENTS 4,523,521 A * 6/1985 Huydts ..... B30B 1/18 100/259
4,916,932 A 4/1990 Obrecht
4,959,989 A 10/1990 Obrecht
5,488,880 A * 2/1996 Sartorio ..... B30B 1/18 254/103
5,630,362 A * 5/1997 Jonsson ..... B30B 1/18 100/126
9,221,600 B2 * 12/2015 Iacobucci ..... B65F 1/1405
2002/0178938 A1 * 12/2002 Futamura ..... B30B 1/186 100/230
2004/0244520 A1 * 12/2004 Cornelius ..... F16H 25/2252 74/424.92
2013/0291609 A1 * 11/2013 Furukawa ..... F16H 25/2015 72/21.4
2014/0245847 A1 * 9/2014 Eriksson ..... F16H 25/24 74/89.32
2015/0068412 A1 * 3/2015 Yanagi ..... B21D 5/004 100/35

* cited by examiner

*Primary Examiner* — Jimmy T Nguyen
(74) *Attorney, Agent, or Firm* — Brooks Kushman P.C.

(57) ABSTRACT

A press assembly includes an elongated guide, and a ram that is at least partially mounted to the elongated guide and axially movable relative to the elongated guide. A fabricating tool is disposed at an outboard end portion of the ram. The ram including an internal chamber. A cylinder is disposed within an internal chamber of the ram and is secured to the ram such that the cylinder is fixed relative to the ram axially and rotationally so that the cylinder and ram move in unison. A spindle having a driving end region and a driven end region opposite the driving end region is disposed at least partially within a cylindrical bore of the cylinder. A motor is adapted to rotate the driving end region of the spindle to effect an axial displacement of the cylinder and the ram.

7 Claims, 4 Drawing Sheets

INTERNALLY-DRIVEN PRESS ASSEMBLY

TECHNICAL FIELD

This disclosure relates to presses and more particularly to presses for performing a work operation on a workpiece.

BACKGROUND

Presses may be used for a myriad of mechanical fabricating operations such as piercing, punching, shape forming, resistance welding or the like. Various presses have been proposed and utilized to perform mechanical fabricating operations. Generally, presses in which a large force is required to perform the desired fabrication operation have tended to be unduly large and cumbersome and, conversely, smaller, less cumbersome presses are often unsatisfactory where a large force is required to perform the desired fabrication operation. Various attempts have been made to provide a relatively small press capable of generating a relatively high force at the fabricating tool, but the commercial application of these presses has been limited by problems related to leakage, durability, and the like.

Among the art considered in preparing this patent application are these references: U.S. Pat. No. 4,916,932 to Obrecht et al. and U.S. Pat. No. 4,959,989 to Obrecht et al., which are directed to presses for performing a work operation on a workpiece.

SUMMARY

In at least one approach, a press assembly is provided. The press assembly may include an elongated guide. The press assembly may further include a ram that may be at least partially mounted in the guide channel and axially movable relative to the frame. The ram may include an internal chamber. The press assembly may further include a fabricating tool that may be disposed proximate an outboard end portion of the ram. The press assembly may further include a cylinder that may be disposed within the internal chamber and that may include a cylindrical bore. The cylinder may be secured to the ram such that the cylinder is fixed relative to the ram axially and rotationally so that the cylinder and ram move in unison. The press assembly may further include a spindle. The spindle may have a driving end region. The spindle may further have a driven end region opposite the driving end region and that may be disposed at least partially within the cylindrical bore. The press assembly may further include means for imparting rotary motion to the spindle to effect a rotational movement of the driving end region and an axial displacement of the cylinder and the ram.

At least a portion of the cylindrical bore may define an internally-threaded cylindrical bore. At least a portion of the driven end region of the spindle may include an externally-threaded driven end region. Roller screws may be disposed between the externally-threaded driven end region and the internally-threaded cylindrical bore. The roller screws may be planetary roller screws that may be rotatable about the externally-threaded driven end region. Rotation of the planetary roller screws about the externally-threaded driven end region may produce the axial displacement of the cylinder and the ram.

The cylinder may include a recess that may be formed in an external surface of the cylinder. The ram may include a through-hole that may be disposed in alignment with the recess when the cylinder is seated within the internal chamber. A key may be sized to extend through the through-hole and to interface with the recess. A removable fastener that may extend through a through-hole of the key and into engagement with the ram to removably secure the key to the ram. The key may be a T-shaped key that may have a head region that interfaces with the ram and a narrowed neck region that interfaces with the ram and the recess of the cylinder. The recess may internally define opposing surfaces and an intermediate surface that may extend between the opposing surfaces. The key may interface with the intermediate surface to inhibit rotational movement of the cylinder relative to the ram, and may interface with the opposing surfaces to inhibit axial movement of the cylinder relative to the ram.

The cylinder may include a plurality of opposing recesses formed in an external surface of the cylinder. The ram may include opposing through-holes, each being disposed in alignment with an individual recess of the opposing recesses. The press assembly may further include removable keys that may extend through the opposing through-holes and that may interface with the opposing recesses to prevent axial and rotational movement of the cylinder relative to the ram.

The press assembly may further include a capping block that may be removably secured to an inboard end of the ram to define at least a portion of the internal chamber. The capping block may include an aperture for receiving the spindle therethrough.

The cylinder may be internally-axially-driven by the spindle. The ram may be externally-axially-guided by the frame. The spindle may be axially fixed relative to the means for imparting rotary motion. The cylinder may be axially moveable relative to the means for imparting rotary motion.

In at least one approach, a press assembly may be provided. The press assembly may include a means for imparting rotary motion, and a ram that may be axially displaceable relative to the means for imparting rotary motion. The press assembly may further include a fabricating tool that may be secured to an end of the ram. The press assembly may further include an inverted roller screw assembly that may be adapted to receive a rotational movement from the means for imparting rotary motion and to axially displace the ram. The inverted roller screw assembly may include a cylinder that may include an internally-threaded cylindrical bore. The cylinder may be secured to the ram such that the cylinder is rotatably and axially fixed relative to the ram. The inverted roller screw assembly may further include a spindle that may include a threaded portion that may extend within at least a portion of the internally-threaded cylindrical bore. The inverted roller screw assembly may further include a plurality of roller screws that may be disposed between and in threaded engagement with the cylinder and the spindle.

The cylinder may define a first central axis. The fabricating tool may define a second central axis that is offset from the first central axis. The second central axis may be vertically and/or horizontally offset from the first central axis.

In at least one approach, a method of operating a press assembly may be provided. The method may include actuating a means for imparting rotary motion to rotate a spindle. Rotation of the spindle may effect rotation of planetary roller screws disposed about an outer perimeter of the spindle. Rotation of the planetary roller screws may effect an axial movement, and not rotational movement, of a cylinder that extends about the planetary roller screws. Axial movement of the cylinder may effect a corresponding axial movement of a ram that is rotationally and axially fixed to the cylinder.

The method may further include actuating the means for imparting rotary motion to engage a workpiece with a fabricating portion of the ram.

The method may further include, prior to actuating the means for imparting rotary motion to rotate a spindle, providing a removable key within a through-hole of the ram and into engagement with the cylinder at a recess disposed in an external surface of the cylinder such that the key prohibits axial and rotational movement of the cylinder relative to the ram.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

A press assembly may be used to fabricate a workpiece. As discussed in greater detail elsewhere herein, the press assembly may include an inverted roller screw assembly that internally drives a ram. The inverted roller screw assembly may include a spindle, planetary roller screws disposed about an outer perimeter of the spindle, and an internally-threaded cylinder disposed about the planetary roller screws. The cylinder may be axially- and rotationally-fixed within an internal chamber of the ram.

In at least one approach, to operate the press assembly, a means for imparting rotary motion, such as a motor, may be actuated to rotate the spindle. Rotation of the spindle may effect rotation of the planetary roller screws about a central axis of the spindle. Rotation of the planetary roller screws may effect an axial movement—and not rotational movement—of the cylinder. As the cylinder is keyed to the ram, axial movement of the cylinder may effect a corresponding axial movement of the ram. Axial movement of the ram may be guided within an elongated guide of the press. In this way, the ram—and a fabricating tool secured to a forward face of the ram—may be driven toward, and into engagement with a workpiece to perform a work operation on the workpiece. The work operation may include one or more of piercing, punching, shape forming, welding, or the like.

Figure 1:
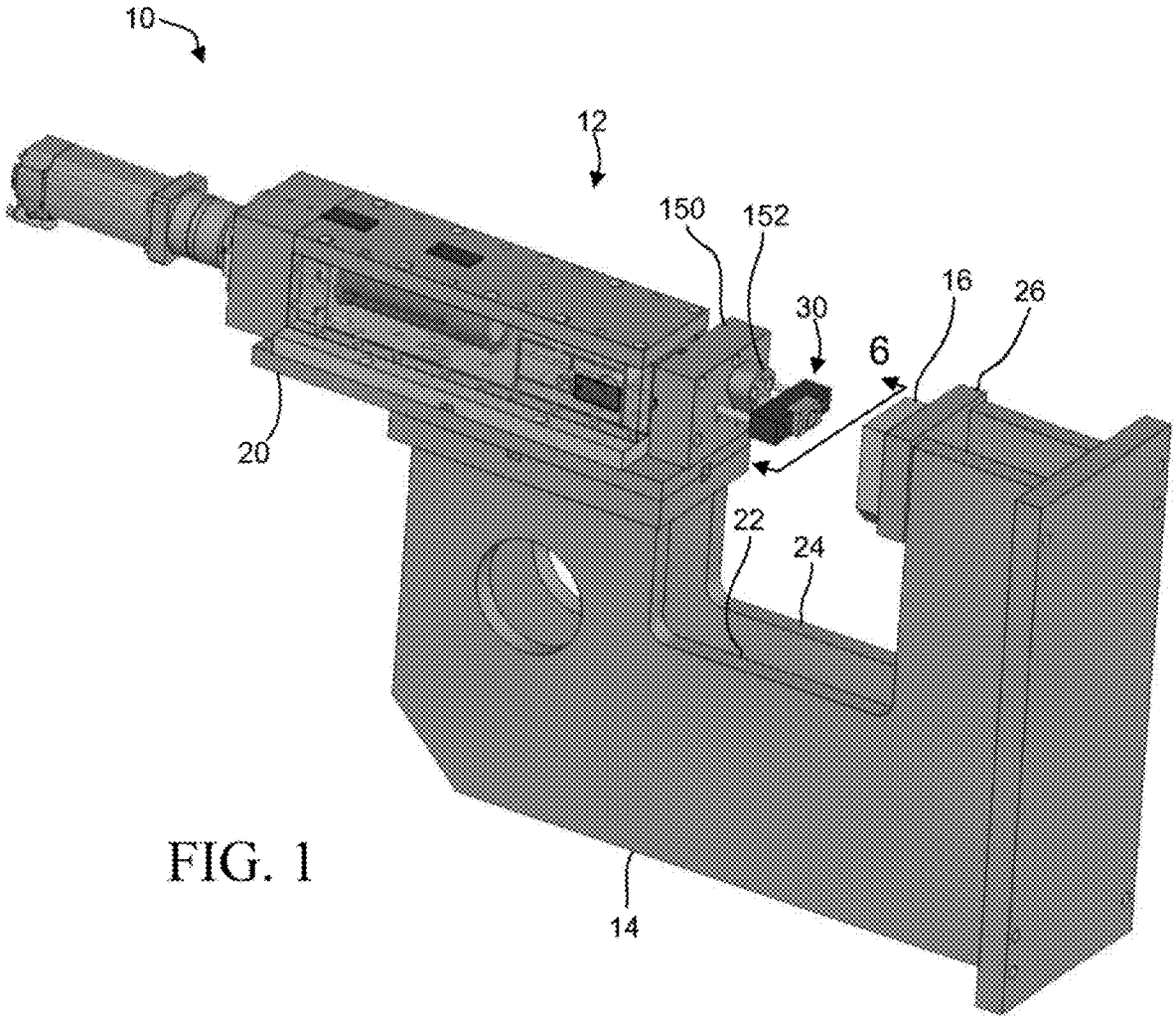
FIG. 1 is a perspective view of a press assembly.

Referring now to FIG. 1, a press assembly 10 may include a press 12, a base 14, and a die 16. The press 12 may be secured to the base 14, for example, through a press retainer plate 20. In this way, at least a portion of the press 12 may be rigidly secured to base 14.

The base 14 may include side plates 22 and 24. In at least one approach, the side plates 22 and 24 may include cutouts that define a generally C-shaped configuration of one or both of the plates 22, 24. Other side plate configurations are expressly contemplated.

The die 16 may be secured to the base 14 through a die retainer plate 26. The press 12 may include a fabricating tool 30 that may be movable relative to the die 16. For example, in a first configuration, the fabricating tool 30 may be spaced apart from the die 16. In this configuration, a workpiece may be provided between the fabricating tool 30 and the die 16; for example, adjacent to the die 16. The fabricating tool 30 may be moved to a second configuration in which the fabricating tool 30 engages the workpiece. As will be appreciated, upon engagement, further movement of the fabricating tool 30 may perform a work operation on the workpiece.

As discussed, the press 12 may be rigidly secured to the base 14 such that at least a portion of the press 12 is movably fixed relative to the base 14. The die 16 may also be rigidly secured to the base 14. In still another approach, one or both of the press 12 and the die 16 may be slidably secured to the base 14. For example, the press 12 may be slidably secured to the base 14 such that a frame of the press 12 is axially movable relative to at least a portion of the base 14. In this way, the press assembly 10 may be a self-equalizing press assembly.

Figure 2:
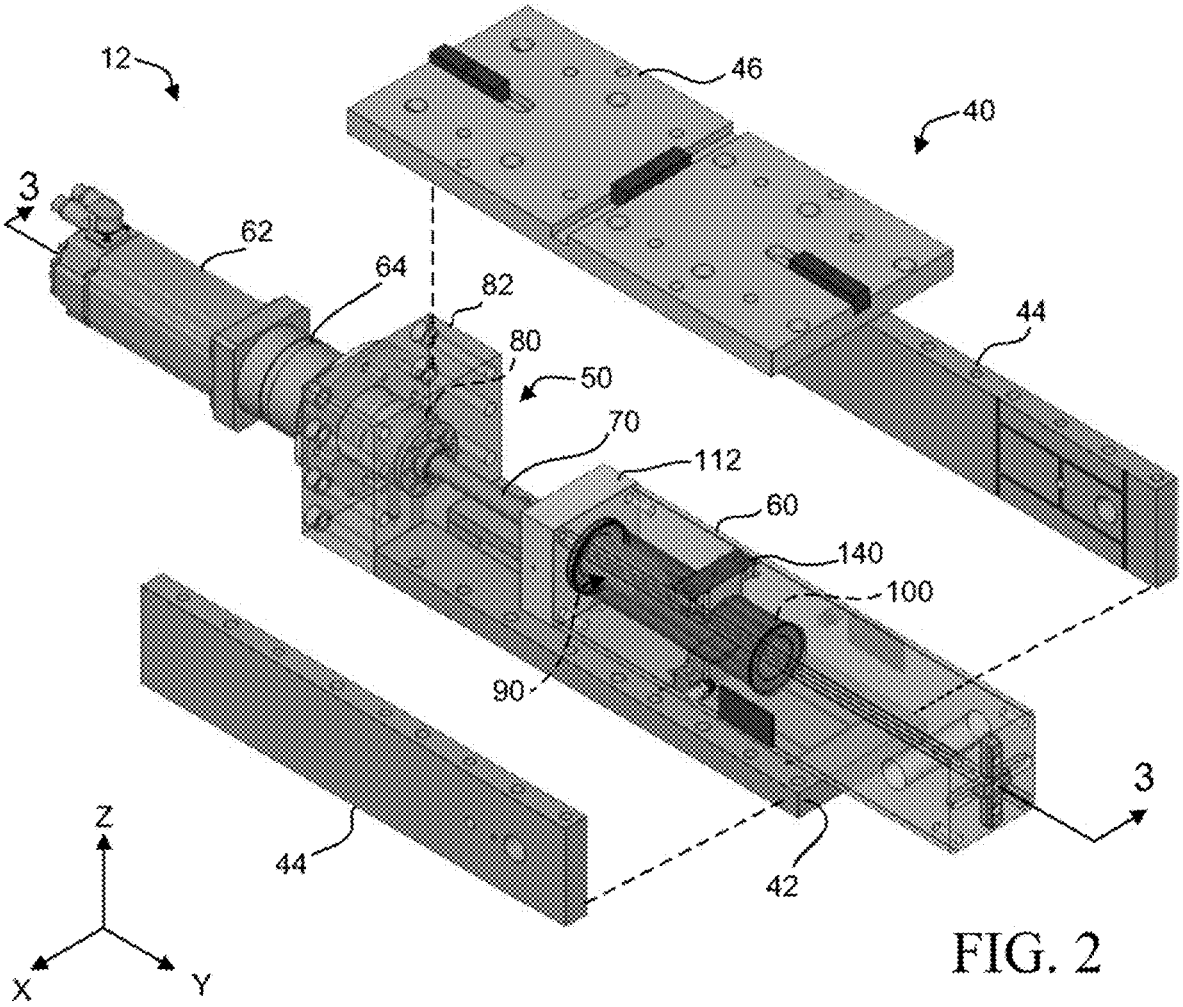
FIG. 2 is a partially exploded view of a press.

Referring to FIG. 2, a press 12 may include a frame, referred to herein as elongated guide 40. The elongated guide 40 may in the form of a guide frame, guide channel, guide member, or other suitable structure. The elongated guide 40 may be formed of one or more walls, which may include guide walls such as bottom wall 42, opposing side walls 44, and top wall 46. The one or more guide walls of the elongated guide 40 may define a guide channel 50 therebetween. The guide walls may be spaced such that the elongated guide 40 may receive a ram 60 within the guide channel 50. The ram 60 may have a substantially polygonal cross-sectional profile; for example, when view in the X-Z plane.

The elongated guide 40 may act as a guide as the ram 60 moves axially within the guide channel 50. For example, the bottom wall 42 may inhibit movement of the ram 60 in a first Z direction, the top wall 46 may inhibit movement of the ram 60 in a second Z direction opposite the first Z direction, and the opposing side walls 44 may inhibit movement of the ram 60 in the X direction. In this way, the elongated guide 40 may guide the ram 60 as it moves axially in the Y direction.

The press 12 may further include a means for imparting rotary motion. Means for imparting rotary motion may include electric motors, hydraulic motors, pneumatic motors, engines, turbines, and their equivalents. For example, the means for imparting rotary motion may include a motor 62, which may include a servo motor. The means for imparting rotary motion may be connected to a coupler, which may be a gear reducer 64. The gear reducer 64 may include, for example, an inline planetary gearbox.

Figure 3:
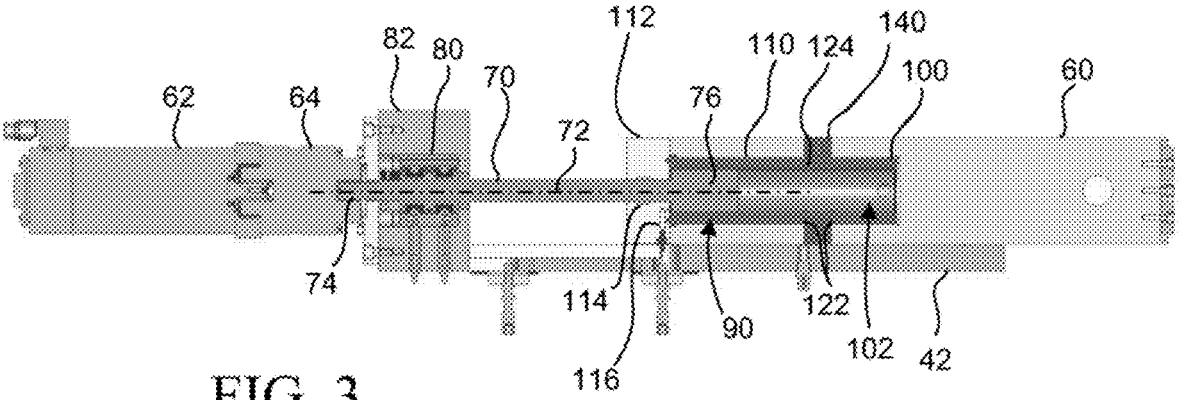
FIG. 3 is a cross-sectional view taken along line 3-3 of FIG. 2.

As shown in FIG. 3, a spindle 70 may extend from the gear reducer 64. The gear reducer 64 may effect a rotational force at a first end portion, also referred to herein as the driving end region 74, of the spindle 70. This may cause the spindle 70 to rotate about a central axis 72. The spindle 70 may be secured to the gear reducer 64 such that the spindle 70 is axially fixed relative to the gear reducer 64. In this way, the spindle 70 may be rotated about the central axis 72, but axial movement of the spindle 70 along the central axis 72 may be inhibited.

The spindle 70 may extend through a bearing assembly 80 that may be housed in a bearing housing 82. The bearing housing 82 may cooperate with the walls of the elongated guide 40 to at least partially define the guide channel 50.

Figure 4:
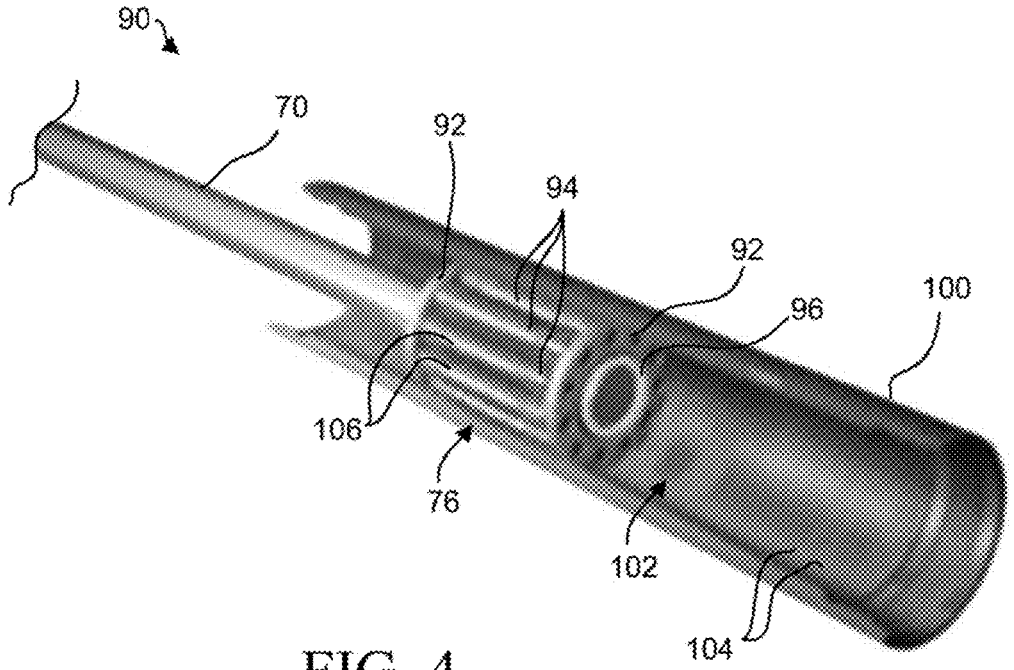
FIG. 4 is a perspective view of an inverted roller screw assembly with a portion of the cylinder removed.

Referring momentarily to FIG. 4, the spindle 70 may be a component of a roller screw assembly, such as inverted roller screw assembly 90. A roller screw assembly, which may also be referred to herein as a planetary roller screw or satellite roller screw, may be a screw-type actuator. The roller screw assembly may be a mechanical device adapted to convert rotational motion to linear motion, or vice versa. A roller screw assembly for use herein may include one or more of a standard roller screw assembly, an inverted roller screw assembly, a recirculating roller screw assembly, and a bearing ring roller screw assembly. Differential roller screws, which may be variants of the standard and recirculating types, may also be utilized.

An inverted roller screw assembly 90 may include one or more (e.g., two opposing) carrier plates 92 disposed about a second end portion of the spindle 70, referred to herein as a driven end region 76. The carrier plates 92 may secure a plurality of rollers, referred to herein as roller screws 94, about the driven end region 76 of the spindle 70. Meshed ring gears 96 may be provided proximate the carrier plates 92. For example, a flange portion of a ring gear 96 may extend between the spindle 70 and the carrier plates 92. The carrier plates 92 may be rotatable about the flange portion of the ring gear 96. The ring gears 96 may be rotatably fixed to the spindle 70, and may be disposed in meshed engagement with the roller screws 94. In this way, rotation of the spindle 70 about the central axis 72 may effect a planetary rotation of the roller screws 94 about the central axis 72.

A cylinder 100 may be disposed about the inverted roller screw assembly 90. The cylinder 100 defines a cylindrical bore 102. The cylinder 100 may further define at least one internal thread 104 that extends within the cylindrical bore 102. In this way, the cylinder bore 102 may be at least partially internally-threaded. The internal threads 104 of the cylinder 100 may receive threads 106 of the roller screws 94. In this way, as the roller screws 94 are rotated about the central axis 72, the roller screws 94 act on the internal threads of the cylinder 100. As previously discussed, the spindle 70 is axially fixed such that the movement of the spindle 70 along the central axis 72 is substantially inhibited. As such, rotation of the roller screws 94 about the central axis 72 effects a linear force on the internal threads 104 of the cylinder 100 and drives the cylinder 100 along the central axis 72.

Referring again to FIG. 3, the cylinder 100 may extend within the ram 60. More particularly, the cylinder 100 may extend within an internal chamber 110 of the ram 60. The internal chamber 110 may be a cylindrical internal chamber 110 sized to receive the cylinder 100. The internal chamber 110 may include an expanded region adapted to receive a flange of an end portion of the cylinder 100.

An intermediate cap, also referred to herein as capping block 112, may be secured (e.g., removably secured) to the ram 60. In at least one approach, the capping block 112 is a multi-piece (e.g., two piece) capping block. A multi-piece capping block may facilitate installation about the spindle 70.

In the installed configuration, the capping block 112 may interface both an end region of the ram 60 and an end region (e.g., including the flange) of the cylinder 100. The capping block 112 may include a spindle aperture that receives the spindle 70 therethrough. A sealing ring 114 may be provided within the spindle aperture to interface a portion of the capping block 112 and the spindle 70. The sealing ring 114 may cooperate with the spindle 70, the capping block 112, and the cylindrical bore 102 of the cylinder 100 to provide a fluid-tight (or substantially fluid-tight) fluid chamber. A fluid inlet 116 may permit selective fluid communication with the fluid chamber. The fluid inlet 116 may also be in fluid connection with a fluid source, such as an oil well. In this way, the fluid chamber may receive oil from the fluid source, and the fluid chamber may act as an internal bath chamber that lubricates the cylindrical bore 102 of the cylinder 100 and components of the inverted roller screw assembly 90.

As discussed, the cylinder 100 may be secured to the ram 60 such that the cylinder 100 is axially fixed to the ram 60. As such, axial movement of the cylinder 100 (e.g., along an axis parallel to central axis 72) may effect a corresponding axial movement of the ram 60. In this regard, a key system may be utilized to axially secure the ram 60 to the cylinder 100.

Figure 5:
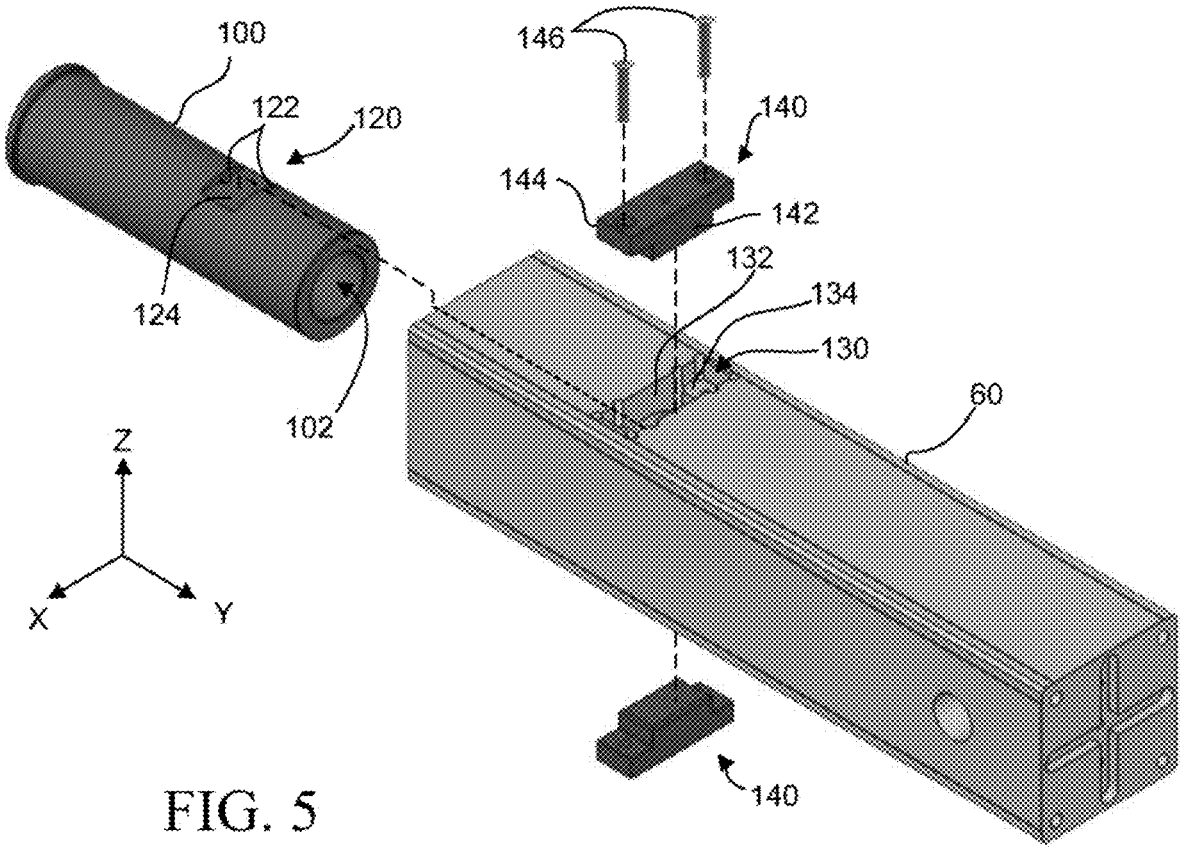
FIG. 5 is an exploded view of a portion of the press.

Referring to FIG. 5, the cylinder 100 may be provided with one or more recesses, also referred to herein as key receptacles 120. A key receptacle 120 may be, for example, machined into an outer cylindrical surface of the cylinder 100. In still another approach, a key receptacle 120 may be integrally formed with the cylinder 100.

A key receptacle 120 may extend through less than an entire wall thickness of the cylinder 100. As such the key receptacles 120 may not interface the wall defining the internally-threaded cylinder bore 102. In at least one approach, the key receptacle 120 may internally define opposing walls or surfaces 122, and an intermediate wall or surface 124 extending between the opposing surfaces 122. In the orientation depicted FIG. 5, the opposing surfaces 122 may be referred to as vertical walls, and the intermediate surface 124 may be referred to as a horizontal wall. Furthermore, as shown, the intermediate surface 124 may be disposed, and may extend, orthogonally relative to the opposing surface 122. Other key receptacle geometries are expressly contemplated.

The ram 60 may include one or more through-holes 130. The through-holes 130 may be disposed in alignment with corresponding key receptacles 120. The through-holes 130 may be defined by one or more planar (e.g, vertical or substantially vertical) walls 132. The through-holes 130 may also be defined by one or more shelf walls 134 that may extend, for example, substantially orthogonally from the planar walls 132.

A key 140 may be provided to interface the ram 60 (e.g., at a through-hole 130) and the cylinder 100 (e.g., at the key receptacle 120). In at least one approach, the key 140 is a T-shaped key having a neck region 142 and a head region 144 that extends from the neck region 142. The neck region 142 may include vertical walls and a bottom wall that extends between the vertical walls. The head region 144 may extend beyond at least one of the vertical walls of the neck region 142 such that a dimension (e.g., length) of the head region 144 is greater than a corresponding dimension of the neck region 142.

The key 140 may be received within a through-hole 130 of the ram 60. In at least one approach, the head region 144 may engage the shelf walls 134 within the through-hole 130. The head region 144 and shelf walls 134 may have aligned fastener interfaces that permit a fastener 146 to secure the key 140 to the ram 60 when the key 140 is in the installed configuration.

Also in the installed configuration, the neck region 142 of the key 140 may interface the key receptacle 120 of the cylinder 100. For example, vertical walls of the neck region 142 may engage the opposing surfaces 122 of the key receptacle 120. In this way, the neck region 142 may inhibit axial movement (e.g., in the Y direction) of the cylinder 100 relative to the ram 60. Furthermore, the bottom wall of the neck region 142 may engage the intermediate surface 124 of the key receptacle 120. In this way, the neck region 142 may further inhibit rotational movement of the cylinder 100 relative to the ram 60.

In the approach shown, the key system may include two through-holes 130 disposed at and extending through opposite walls of the ram 60, two key receptacles 120 disposed on opposite surfaces of the cylinder 100, and two keys 140, each extending through a through-hole 130 and a corresponding key receptacle 120.

Although described herein as a key system, other suitable approaches are expressly contemplated for axially and rotatably locking the ram 60 with the cylinder 100. For example, one or more removable fasteners (e.g., threaded fasteners) may inserted through the ram 60 and at least a portion of the cylinder 100 to lock the cylinder 100 to the ram 60. Other approaches may include the use of wedges, latches, locks, locking rods, etc. to axially and rotatably lock the ram 60 with the cylinder 100.

Figure 6:
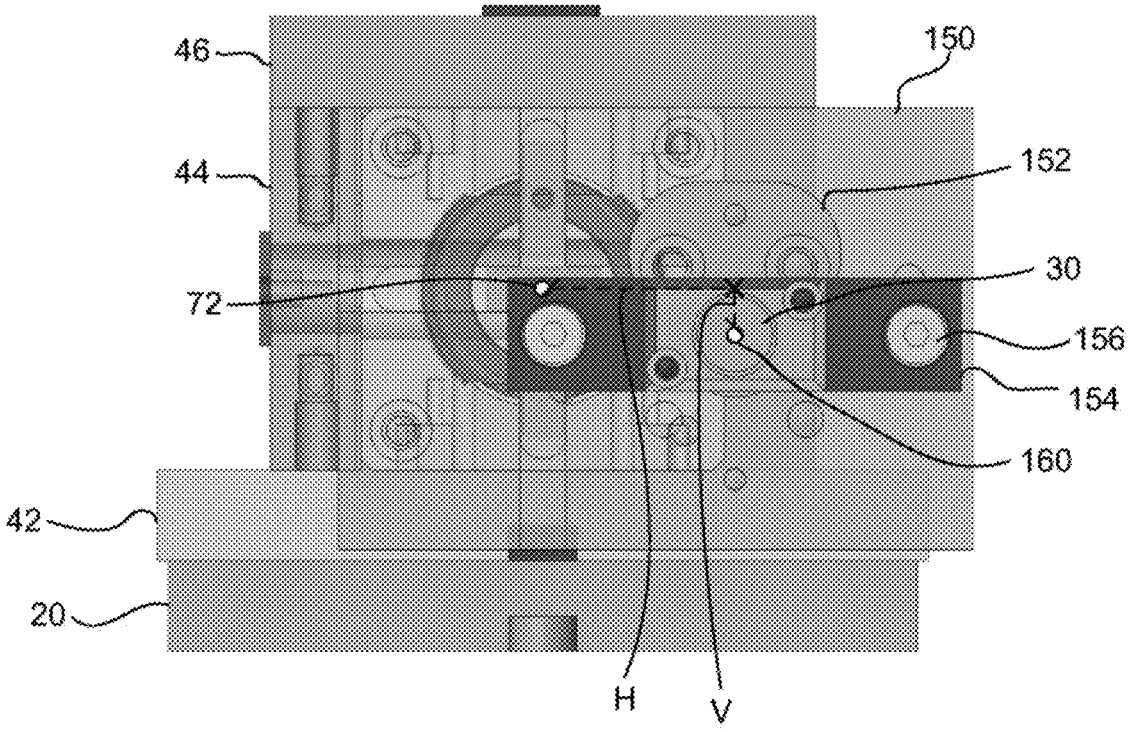
FIG. 6 is a cross-sectional view taken along line 6-6 of FIG. 1.

Referring to FIG. 6, a fabricating assembly may include a tool plate 150 that may be removably secured to a front face of the ram 60. A retainer 152 may be removably secured to the tool plate 150. A tool guide 154 may also be rotatably fixed relative to the tool plate 150, for example, by a plurality of spring-loaded rods 156. A fabricating tool 30 may extend through the retainer 152 and through the tool guide 154. The fabricating tool 30 may be, for example, a ball lock punch, or any fabricating tool for use with performing a work operation on a workpiece.

As shown in FIG. 6, the press assembly 10 contemplated herein permits a fabricating tool 30 to be driven along an axis 160 that may be offset from the central axis 72 of the spindle 70. The offset may be along the X-axis, the Y-axis, the Z-axis, or any combination thereof. For example, the axis 160 may be horizontally offset (as indicated by "H"), vertically offset (as indicated by "V"), or both horizontally offset and vertically offset from the central axis 72 of the spindle 70. This may be due to the uniform force extorted across the front face of the ram 60, which may be evenly distributed across the tool plate 150. As such, the force in the axial direction is not contingent upon the central axis of the fabricating tool 30 being coaxial with the central axis 72 of the spindle 70, or the central axis of the cylinder 100 (which may be coaxial with central axis 72).

While exemplary embodiments are described above, it is not intended that these embodiments describe all possible forms encompassed by the claims. The words used in the specification are words of description rather than limitation, and it is understood that various changes may be made without departing from the spirit and scope of the disclosure. As previously described, the features of various embodiments may be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. These attributes may include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and may be desirable for particular applications.

Table of Reference Numerals:

| | |
|---|---|
| 10 | press assembly |
| 12 | press |
| 14 | base |
| 16 | die |
| 20 | press retainer plate |
| 22 | side plate |
| 24 | side plate |
| 26 | die retainer plate |
| 30 | tool |
| 40 | elongated guide |
| 42 | bottom wall |
| 44 | side walls |
| 46 | top wall |
| 50 | guide channel |
| 60 | ram |
| 62 | motor |
| 64 | gear reducer |
| 70 | spindle |
| 72 | central axis |
| 74 | driving end region |
| 76 | driven end region |
| 80 | bearing assembly |
| 82 | bearing housing |
| 90 | inverted roller screw assembly |
| 92 | carrier plates |
| 94 | roller screws |
| 96 | ring gear |
| 100 | cylinder |
| 102 | cylindrical bore |
| 104 | internal threads |
| 106 | threads |
| 110 | internal chamber |
| 112 | capping block |
| 114 | sealing ring |
| 116 | fluid inlet |
| 120 | key receptacle |
| 122 | opposing surfaces |
| 124 | intermediate surface |
| 130 | through-hole |
| 132 | planar wall |
| 134 | shelf walls |
| 140 | key |
| 142 | neck region |
| 144 | head region |
| 146 | fastener |
| 150 | tool plate |
| 152 | retainer |
| 154 | tool guide |
| 156 | rods |
| 160 | axis |

What is claimed is:

1. A press assembly comprising:

an elongated guide;

a ram at least partially mounted to the elongated guide and being axially movable relative to the elongated guide, the ram including an internal chamber;

a fabricating tool disposed proximate an outboard end portion of the ram;

a cylinder disposed within the internal chamber and including a cylindrical bore that includes at least one internal thread, the cylinder being secured to the ram such that the cylinder is fixed relative to the ram axially and rotationally so that the cylinder and ram move in unison, the cylinder including a recess formed in an external surface of the cylinder;

a spindle having a driving end region and a driven end region opposite the driving end region, the spindle including at least one external thread, the driven end region being disposed at least partially within the cylindrical bore;

means for imparting rotary motion to the spindle to effect a rotational movement of the driving end region and an axial displacement of the cylinder and the ram, the ram including a through-hole disposed in alignment with the recess when the cylinder is seated within the internal chamber.

2. The press assembly of claim 1 further comprising a key sized to extend through the through-hole and into locking engagement with the cylinder at the recess.

3. The press assembly of claim 2 further comprising a removable fastener that extends through a through-hole of the key and into engagement with the ram to removably secure the key to the ram.

4. The press assembly of claim 2 wherein the key is a T-shaped key having a head region that interfaces with the ram and a narrowed neck region that interfaces with the ram and the recess of the cylinder.

5. The press assembly of claim 4 wherein the recess internally defines opposing surfaces and an intermediate surface extending between the opposing surfaces.

6. The press assembly of claim 5 wherein the key interfaces with the intermediate surface to prevent rotational movement of the cylinder relative to the ram, and interfaces with the opposing surfaces to prevent axial movement of the cylinder relative to the ram.

7. A press assembly comprising:

an elongated guide;

a ram at least partially mounted to the elongated guide and axially movable relative to the elongated guide, the ram including an internal chamber;

a fabricating tool disposed proximate an outboard end portion of the ram;

a cylinder disposed within the internal chamber and including a cylindrical bore that includes at least one internal thread, the cylinder being secured to the ram such that the cylinder is fixed relative to the ram axially and rotationally so that the cylinder and ram move in unison;

a spindle having a driving end region, and a driven end region opposite the driving end region and that includes at least one external thread, the driven end region disposed at least partially within the cylindrical bore;

planetary roller screws disposed between the external thread and the internal thread and rotatable about the external thread; and means for imparting rotary motion to the spindle to effect a rotational movement of the driving end region and an axial displacement of the cylinder and the ram, wherein the cylinder includes a plurality of opposing recesses formed in an external surface of the cylinder, wherein the ram includes opposing through-holes, each being disposed in alignment with an individual recess of the opposing recesses, and wherein the press assembly further includes removable keys that extend through the opposing through-holes and that interface with the opposing recesses to prevent axial and rotational movement of the cylinder relative to the ram.

* * * * *